US006470721B2

(12) United States Patent
Ming

(10) Patent No.: US 6,470,721 B2
(45) Date of Patent: Oct. 29, 2002

(54) STRENGTH REINFORCING STRUCTURE OF A LOCK OUTER HANDLE

(75) Inventor: Huang Chao Ming, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 43 days.

(21) Appl. No.: 09/754,363

(22) Filed: Jan. 5, 2001

(65) Prior Publication Data

US 2002/0088258 A1 Jul. 11, 2002

(51) Int. Cl.[7] ..... G05G 5/05

(52) U.S. Cl. ..... 70/224; 70/417; 70/215; 70/210; 70/216; 70/478; 70/484; 70/485

(58) Field of Search ..... 70/210, 215, 216, 70/224, 417, 478, 484, 485, 212

(56) References Cited

U.S. PATENT DOCUMENTS 4,201,069 A * 5/1980 Katayama et al. ..... 70/224
5,301,526 A * 4/1994 Fann et al. ..... 292/169.17
5,904,232 A * 5/1999 Shen ..... 192/69.62
5,927,777 A * 7/1999 Kuo et al. ..... 292/358
6,038,894 A * 3/2000 Hu ..... 292/336.5
6,357,270 B1 * 3/2002 Vazquez ..... 292/336.3

* cited by examiner

*Primary Examiner*—Lloyd A. Gall
*Assistant Examiner*—Chris Boswell
(74) *Attorney, Agent, or Firm*—Bacon & Thomas, PLLC

(57) ABSTRACT

A strength reinforcing structure of a lock outer handle includes a disk seat defining a first hole rotatably receiving a handle and a drive shaft tube. The handle has a drive plate rotated by a lock core to drive a lock snapping plate to move longitudinally. The drive shaft tube has one end secured in the handle, and the other end provided with locking grooves for securing locking blocks of a driven ring which is combined with a drive tube which is combined with a restoring member which defines fitting slots combined on the drive shaft tube. The drive tube passes through a positioning plate which defines a second hole provided with locking edges engaged or disengaged with end edges of the lock snapping plate.

14 Claims, 6 Drawing Sheets

STRENGTH REINFORCING STRUCTURE OF A LOCK OUTER HANDLE

BACKGROUND OF THE INVENTION

1. Field of the Invention

The present invention relates to a strength reinforcing structure of a lock outer handle, and more particularly to a lock having a circular handle or flat handle, wherein the strength of the lock can be enhanced.

2. Description of the Related Prior Art

A conventional lock in accordance with the prior art shown in FIG. 10 comprises an axial tube 91 combined with a restoring plate 92 which defines a square hole 921 for passage of a drive shaft 93. By rotation of the handle 95, the drive shaft 93 drives a lock latch to drive a drive wheel to rotate, thereby pulling the lock tongue of the lock latch to extend or retract. The restoring plate 92 is provided with protrusions 922 rested on the fixing tubes 94 of the inner and outer handle sets for limiting the rotation angle of the handle 95. When locked, the drive plate 96 is rotated to move a lock snapping plate 97 in a positioning slot 99 to enter a stop chute 98, whereby the lock snapping plate 97 is locked in the stop chute 98, so that the drive shaft tube 91 cannot be rotated by rotating the handle 95 without a correct key.

If the handle is rotated when the lock is locked, the force from the handle is transmitted to the axial tube 91 whose positioning slot 99 together with the lock snapping plate 97 is used to support the entire breaking force. When the force reaches a determined extent, the positioning slot 99 will be broken, so that the axial tube 91 can be rotated to unlock the lock. In addition, when the lock is at an unlocked state, the user generally rotate the handle to the maximum to open the door, so that the combination position of the restoring plate 92 and the axial tube 91 supports a larger force and is easily worn out during a long-term utilization, thereby forming an idle gap when the handle 95 is rotated. Further, the restoring plate 92 is provided with protrusions 922 rested on the fixing tubes 94 of the inner and outer handle sets for limiting the rotation angle of the handle 95, so that the protrusions 922 are easily worn out during a long-term utilization.

SUMMARY OF THE INVENTION

The primary objective of the present invention is to provide a strength reinforcing structure of a lock outer handle, having a greater strength, so that the lock can be used during a long-term utilization.

In accordance with the present invention, there is provided a strength reinforcing structure of a lock outer handle including a disk seat defining a first hole in which a handle and a drive shaft tube are rotatably mounted. The handle is provided with a drive plate that is driven by a lock core to rotate, and may drive a lock snapping plate to move along a longitudinal direction thereof. The drive shaft tube has one end secured in the handle, the drive shaft tube receives an elastic member and a stop plate therein and defines a positioning slot for allowing protrusion of the lock snapping plate, and the other end of the drive shaft tube is provided with locking grooves in which the locking blocks of a driven ring is locked. The driven ring is combined with a drive tube which is combined with a restoring member. The restoring member defines fitting slots combined on end edges of the drive shaft tube, and the restoring member includes a restoring element mounted thereon. The drive tube also passes through a positioning plate which defines openings locked on the positioning tubes of the disk seat. The positioning plate has a center defining a second hole which has an inner wall provided with locking edges for allowing engagement or disengagement of end edges of the lock snapping plate. The second hole of the positioning plate is additionally provided with stop protrusions protruding toward the center there.

Further benefits and advantages of the present invention will become apparent after a careful reading of the detailed description with appropriate reference to the accompanying drawings.

DETAILED DESCRIPTION OF THE PREFERRED EMBODIMENTS

Figures 1, 2:
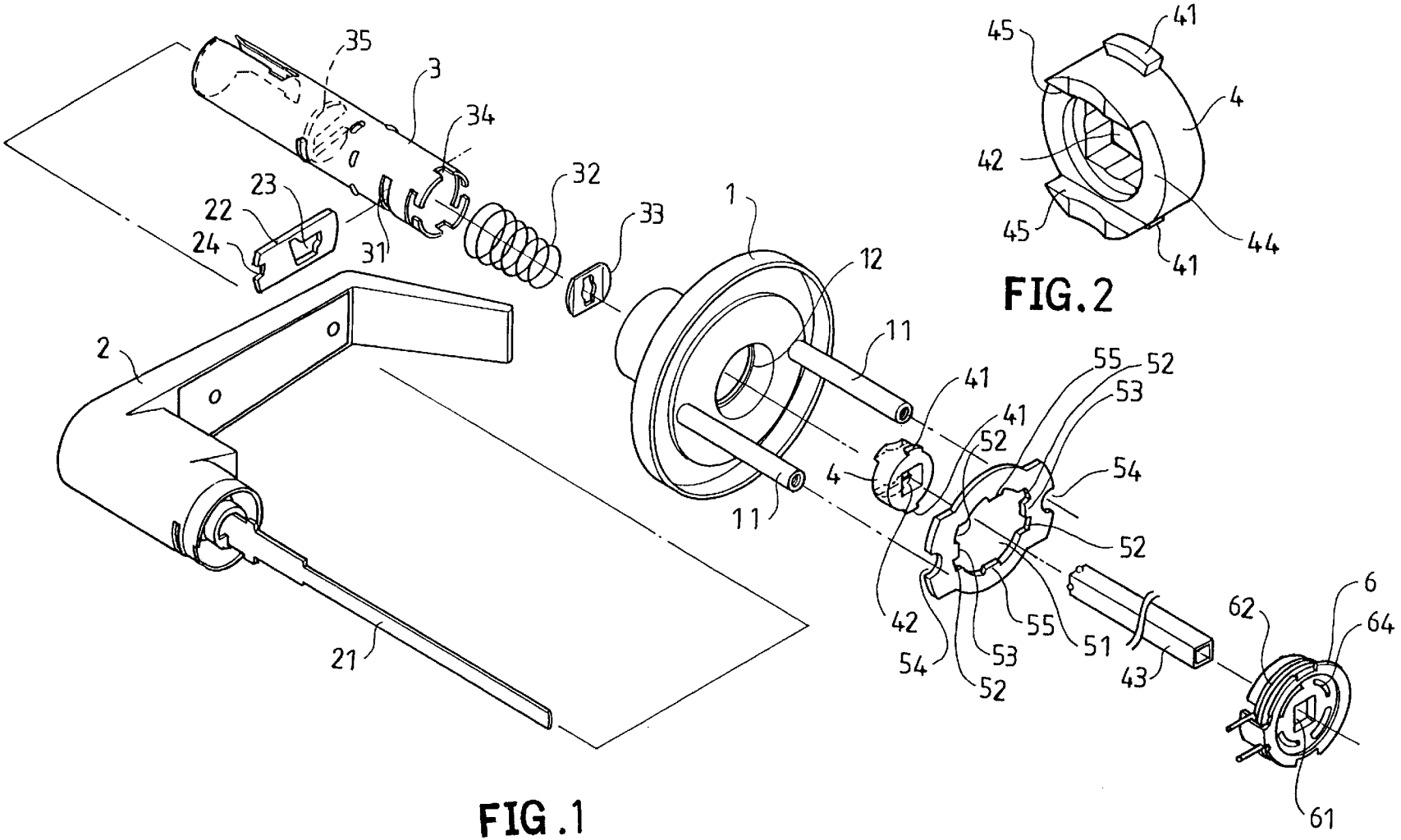
FIG. 1 is an exploded perspective view of a strength reinforcing structure of a lock outer handle in accordance with a first embodiment of the present invention.
FIG. 2 is a perspective view of a driven ring of the strength reinforcing structure of a lock outer handle as shown in FIG. 1.

Referring to the drawings and initially to FIG. 1 of the figures, a strength reinforcing structure of a lock outer handle in accordance with the present invention comprises a disk seat 1, a handle 2, a drive shaft tube 3, a driven ring 4, a positioning plate 5, and a restoring member 6.

Figure 3:
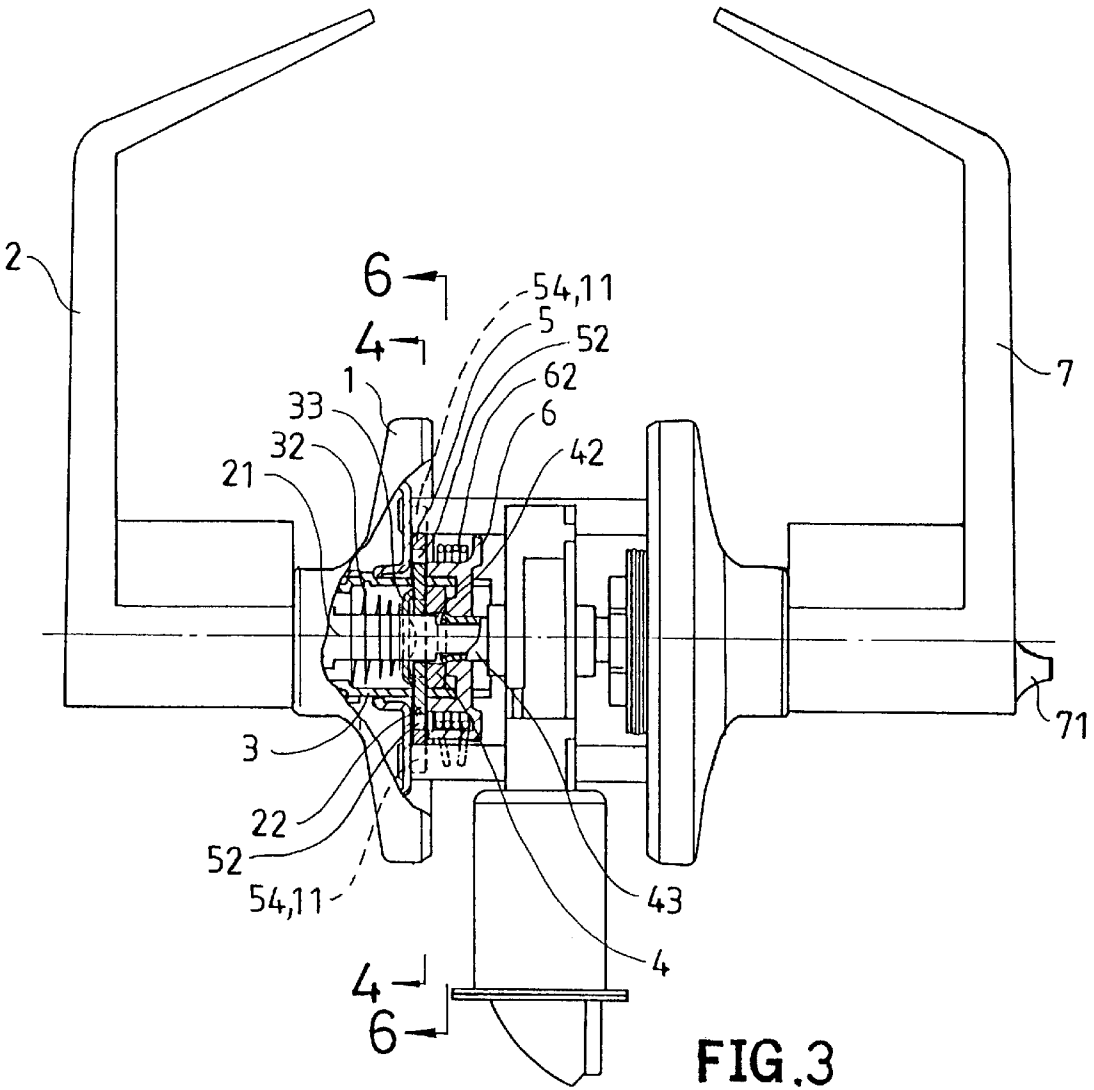
FIG. 3 is a top plan cross-sectional assembly view of the strength reinforcing structure of a lock outer handle as shown in FIG. 1.

The disk seat 1 is provided with positioning tubes 11 for allowing bolts to combine with an inner handle set 7 (see FIG. 3). The disk seat 1 itself defines a hole 12 in which the handle 2 and the drive shaft tube 3 are rotatably mounted in a positioning manner.

The handle 2 may have a conventional construction, and may be a circular handle or have a shape as shown in the figure. The handle 2 has a lock core structure (not shown) which drives a drive plate 21 to rotate by a correct key the drive plate 21 passes through a drive slot 23 defined in a lock snapping plate 22, whereby the lock snapping plate 22 is driven by the drive plate 21 to move along a longitudinal direction thereof, so that the lock snapping plate 22 may slide in the positioning slot 31 of the drive shaft tube 3. When the lock snapping plate 22 slides in the positioning slot 31 of the drive shaft tube 3 to protrude outward from either side thereof, the lock snapping plate 22 may be locked in the locking edges 52 of the positioning plate 5 to form a lock state, so that the drive shaft tube 3 cannot be rotated. If necessary, the lock snapping plate 22 defines locking recesses 24, and the positioning plate 5 is provided with locking pieces 53 that may be locked in the locking recesses 24, so that when the lock snapping plate 22 is locked with the positioning plate 5, the optimal locking effect is formed therebetween.

The drive shaft tube 3 has one end secured in the handle 2, and the other end of the drive shaft tube 3 extended through the fitting slots 64 of the restoring member 6 to combine with the restoring member 6. The restoring member 6 defines a fitting hole 61 for allowing passage of a drive tube 43 which drives the restoring member 6 to rotate simultaneously. Therefore, when the drive shaft tube 3 is rotated, the combination position of the restoring member 6 and the drive shaft tube 3 can be used to function as a first layer of power transmission, so as to rotate the drive tube 43. The drive shaft tube 3 is provided with a positioning slot 31, so that the lock snapping plate 22 is driven to move in the positioning slot 31 along a longitudinal direction thereof. The drive shaft tube 3 receives an elastic member 32 and a stop plate 33 therein, and the drive shaft tube 3 is provided with locking grooves 34 for allowing locking of the locking blocks 41 of the driven ring 4. The two ends of the elastic member 32 are respectively rested on the stop plate 33 and a resting member 35 which is secured in the drive shaft tube 3. Therefore, by pressing of the elastic member 32, the lock snapping plate 22 is pressed, thereby retaining the lock snapping plate 22 in place.

Referring to FIGS. 1 and 2, the driven ring 4 is placed in the drive shaft tube 3, and has locking blocks 41 locked in the locking grooves 34 of the drive shaft tube 3. The driven ring 4 defines a non-circular fitting hole 42 for allowing passage of the drive tube 43 which drives the driven ring 4 to rotate. If necessary, the drive tube 43 is integrally formed with the driven ring 4. The driven ring 4 defines a channel 44 for securing the lock snapping plate 22 therein, and the channel 44 has two sides forming two walls 45 for allowing resting of two sides of the lock snapping plate 22. By the locking engagement between the locking block 41 and the locking groove 34, the rotational force from the handle 2 may be transmitted to the lock snapping plate 22 through the positioning slot 31, and may also be transmitted to the wall 45 through the locking groove 34 and the locking block 41, and is then transmitted to the lock snapping plate 22 through the wall 45, whereby the two sides of the lock snapping plate 22 can be used to support the rotational force, so that the drive shaft tube 3 has a second layer of power transmission, and can then drive the drive wheel of the lock latch by the drive tube 43, so that the lock tongue can extend or retract.

Referring to FIG. 1, the positioning plate 5 defines a hole 51 allowing passage of the drive shaft tube 3, and the positioning plate 5 is rested on the disk seat 1. The positioning plate 5 defines two openings 54 locked on the positioning tubes 11 of the disk seat 1, so that the positioning plate 5 is fixed and cannot be rotated. The hole 51 has an inner wall provided with locking edges 52 for allowing engagement or disengagement of end edges of the lock snapping plate 22. If necessary, the lock snapping plate 22 defines locking recesses 24, and the positioning plate 5 is provided with locking pieces 53 that may be locked in the locking recesses 24 of the lock snapping plate 22, thereby forming an optimal locking effect therebetween. The hole 51 of the positioning plate 5 is also provided with stop protrusions 55 protruding toward the center thereof, so that the lock snapping plate 22 may be rested on the stop protrusion 55 during rotation, thereby forming a resting positioning effect after rotation.

The restoring member 6 defines fitting slots 64 combined on the end face of the drive shaft tube 3, and the restoring member 6 defines a fitting hole 61 for allowing passage of the drive tube 43. If necessary, the restoring member 6 is integrally formed with the drive tube 43, and includes a restoring element 62 such as a conventional torsion spring. The two ends of the restoring member 6 are rested on the positioning tubes 11, so that the rotational handle 2 can be restored when the rotational force is removed.

Figure 5:
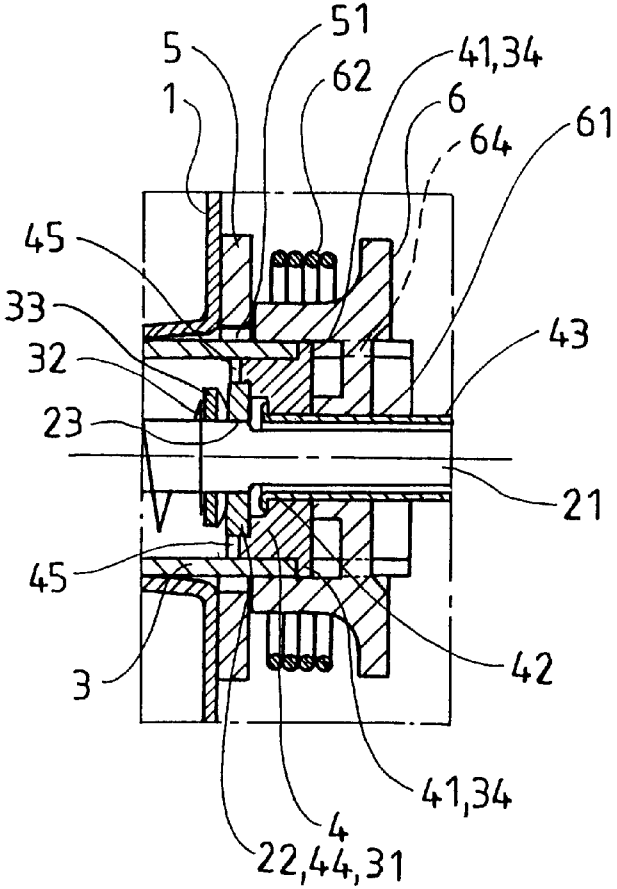
FIG. 5 is a cross-sectional view of the strength reinforcing structure of a lock outer handle along the line 5—5 as shown in FIG. 4.
Figure 4:
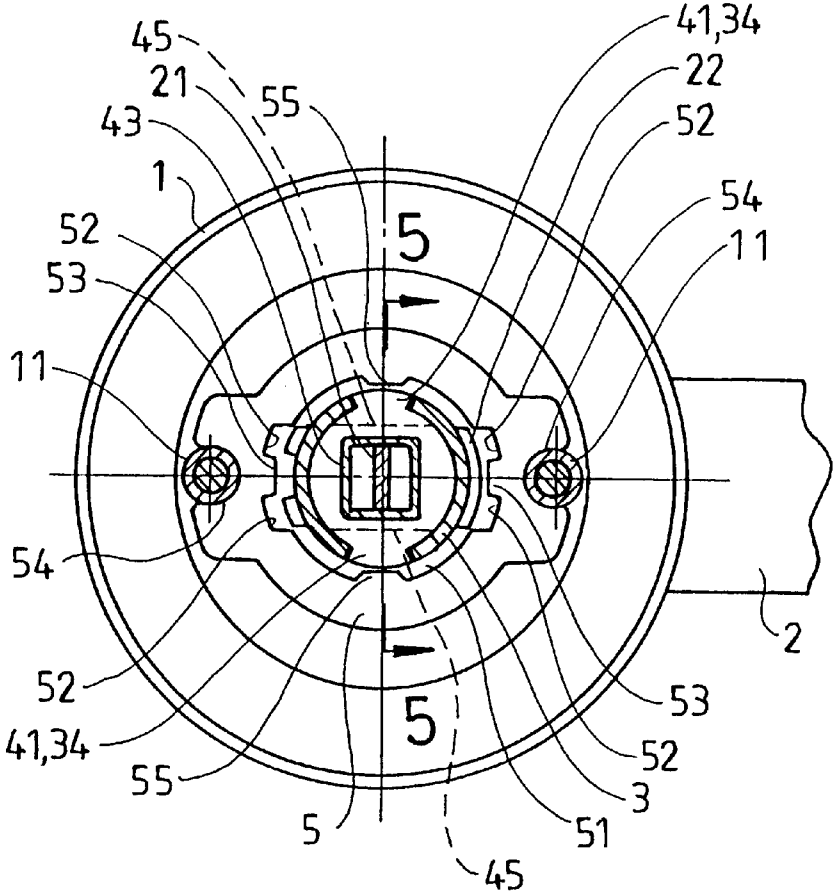
FIG. 4 is a side plan cross-sectional view of the strength reinforcing structure of a lock outer handle along the line 4—4 as shown in FIG. 3.
Figure 7:
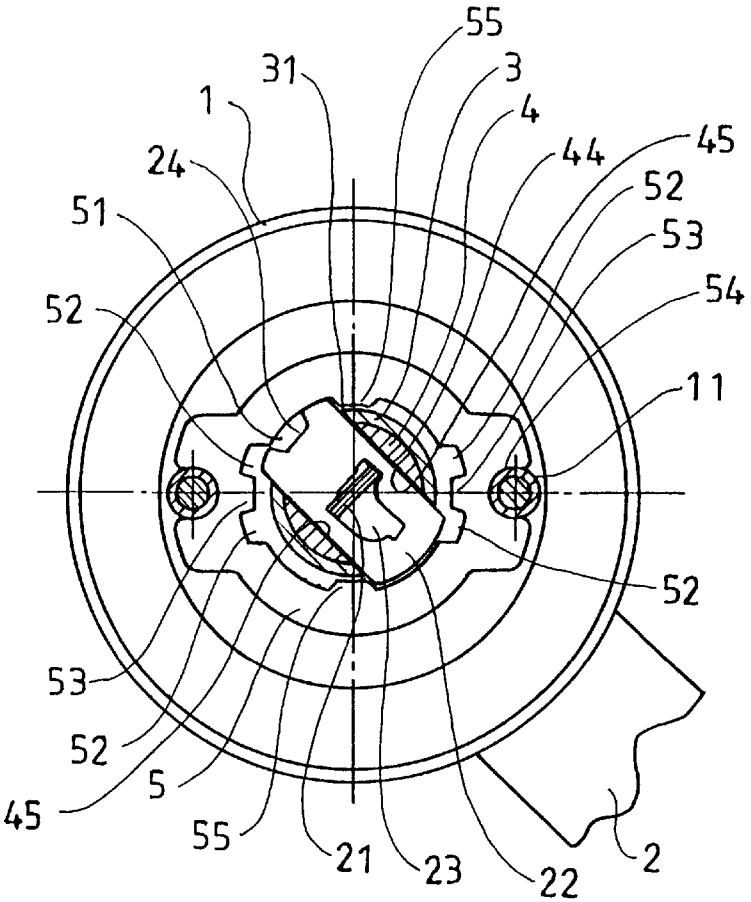
FIG. 7 is an operational view of the strength reinforcing structure of a lock outer handle as shown in FIG. 6.
Figure 6:
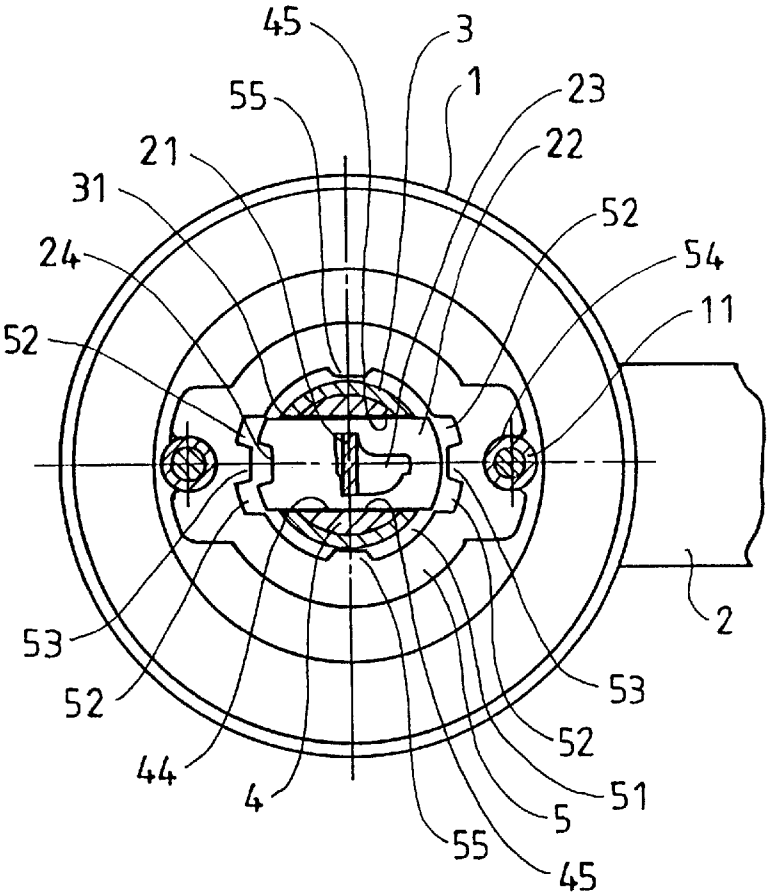
FIG. 6 is a side plan cross-sectional view of the strength reinforcing structure of a lock outer handle along the line 6—6 as shown in FIG. 3.

Referring to FIGS. 3–5, the figures show the unlocked situation of the strength reinforcing structure of a lock outer handle in accordance with the present invention. The elastic member 32 and the stop plate 33 are placed in the drive shaft tube 3, and are urged on the lock snapping plate 22, so that the lock snapping plate 22 is rested on the driven ring 4 which is rested on the restoring member 6 which is combined on the end edge of the drive shaft tube 3. At the same time, the drive plate 21 is maintained at a vertical position, so that the lock snapping plate 22 does not enter the locking edge 52 of the positioning plate 5. Therefore, the lock snapping plate 22 can be driven to rotate by the drive shaft tube 3 (as shown in FIGS. 6 and 7). When the drive shaft tube 3 is rotated, the lock snapping plate 22 is rested on the stop protrusion 55 of the positioning plate 5, so that the drive shaft tube 3 cannot be rotated farther.

Figure 8:
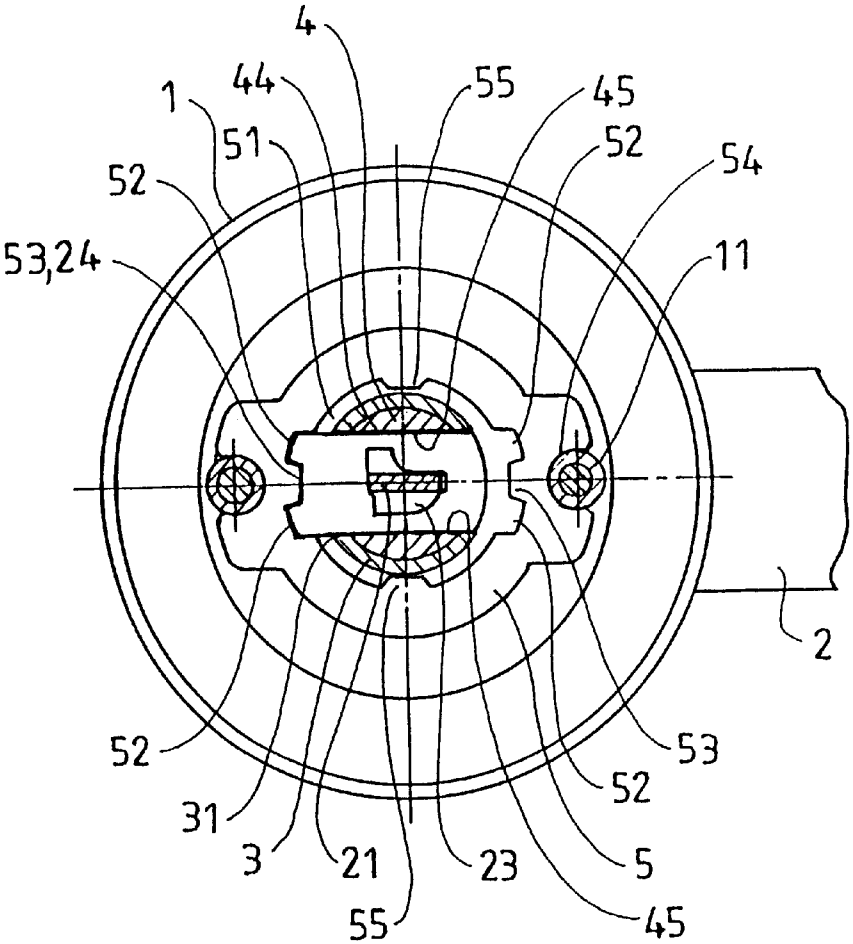
FIG. 8 is an operational view of the strength reinforcing structure of a lock outer handle as shown in FIG. 6.
Figure 10:
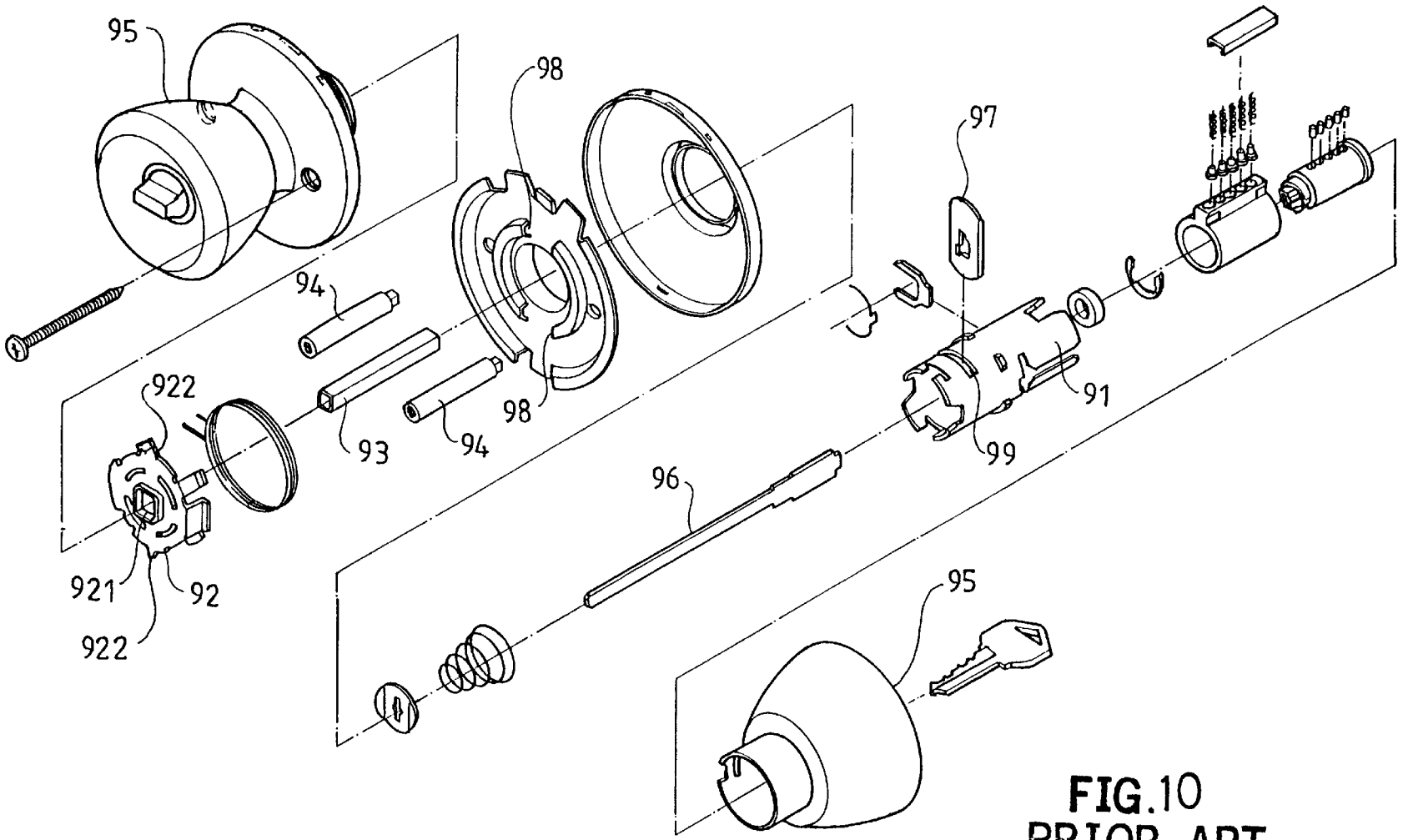
FIG.10 PRIOR ART
FIG. 10 is an exploded perspective view of a conventional lock in accordance with the prior art.

Referring to FIG. 8, when the user wishes to lock the lock device, a correct key may be inserted into the lock core of the handle 2, or the user may rotate the rotation button 71 of the inner handle set 7 (as shown in FIG. 3), so as to drive the drive plate 21 to rotate. Meanwhile, the drive plate 21 is located at a horizontal position, so that the lock snapping plate 22 is driven to lock into the locking edge 52 of the positioning plate 5. At the locking state, when an external force is exerted on the handle 2 to rotate it, the rotational force is transmitted through the handle 2 to the drive shaft tube 3 that transmits part of the rotational force to the lock snapping plate 22 through the positioning slot 31, and transmits the other part of the rotational force through the locking groove 34 to the locking block 41 (see FIG. 4) which transmits the rotational force through the body of the driven ring 4 to the walls 45 at the two sides of the channel 44. The walls 45 are rested on the two sides of the lock snapping plate 22, so that the rotational force is transmitted to the large area of the two sides of the lock snapping plate 22, thereby distributing and absorbing the rotational force. Accordingly, the drive shaft tube 3 has two force supporting points (the positioning slot 31 and the locking groove 34), thereby distributing the breaking force and thereby enhancing the strength.

Figure 9:
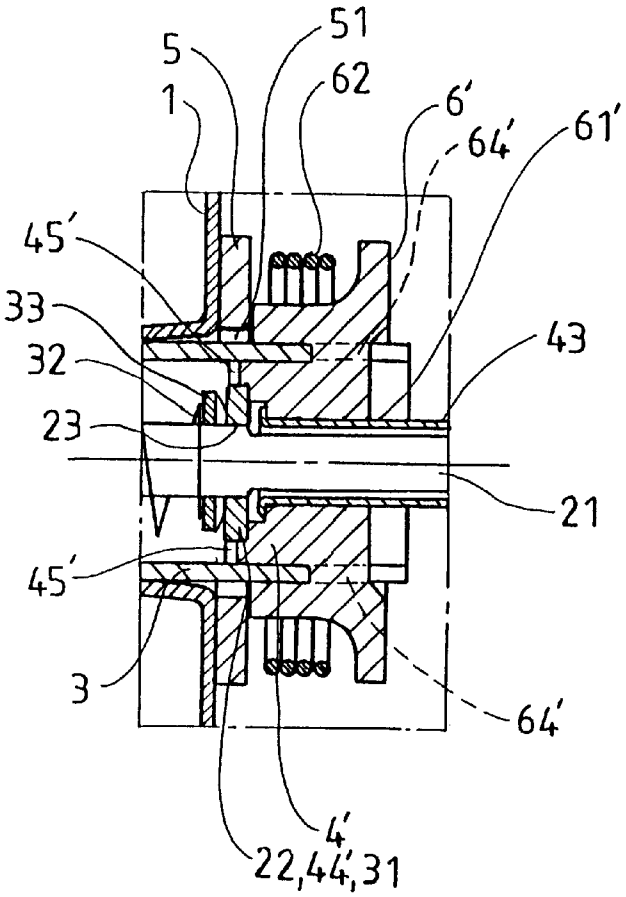
FIG. 9 is a cross-sectional assembly view of a strength reinforcing structure of a lock outer handle in accordance with a second embodiment of the present invention.

Referring to FIG. 9, in accordance with another embodiment of the present invention, the driven ring 4 and the restoring member 6 are integrally formed with each other to form a restoring member 6', and the other parts are not changed. The restoring member 6' defines fitting slots 64' combined on the end face of the drive shaft tube 3, and the restoring member 6' defines a fitting hole 61' fitted on the drive tube 43. The driven ring 4' is mounted in the center of the restoring member 6', and defines a channel 44' for allowing insertion of the lock snapping plate 22. The two sides of the channel 44' form walls 45' rested on the two sides of the lock snapping plate 22. When the drive shaft tube 3 is forced by an external force to rotate, part of the rotational force is transmitted to the lock snapping plate 22 through the positioning slot 31, and the other part of the rotational force is transmitted from the restoring member 6' through the driven ring 4' to the walls 45' at the two sides of the channel 44', and the two sides of the lock snapping plate 22 are used to support the force, thereby distributing the breaking force and thereby enhancing the strength.

In accordance with the construction of the present invention, the drive shaft tube 3 co-operates with the restoring member 6 to function as a first layer of power transmission. By the locking engagement between the locking groove 34 of the drive shaft tube 3 and the locking block 41 of the driven ring 4, the locking groove 34 and the locking block 41 may be used as a second layer of power transmission of the drive shaft tube 3 to drive the drive tube 43 to rotate, while the positioning slot 31 and the locking groove 34 support the force together, there increasing the strength, so that the lock cannot be easily broken. In addition, when the handle 2 is rotated, the lock snapping plate 22 is rested on the stop protrusion 55 of the positioning plate 5, so that the handle 2 has a better positioning effect, thereby increasing the strength and lifetime of the lock.

Although the invention has been explained in relation to its preferred embodiment as mentioned above, it is to be understood that many other possible modifications and variations can be made without departing from the scope of the present invention. It is, therefore, contemplated that the appended claim(s) will cover such modifications and variations that fall within the true scope of the invention.

What is claimed is:

1. A strength reinforcing structure of a lock outer handle comprising:

a disk seat, having positioning tubes and defining a first hole;

a handle, pivotally mounted in the first hole of the disk seat to rotate, the handle provided with a drive plate that is driven by a lock core to rotate and drive a lock snapping plate to move along a longitudinal direction thereof, the lock snapping plate having a plurality of locking recesses;

a drive shaft tube, pivotally mounted in the first hole of the disk seat, having one end secured in the handle, the drive shaft tube receiving an elastic member and a stop plate therein and defining a positioning slot for allowing protrusion of the lock snapping plate, and the other end of the drive shaft tube provided with a plurality of locking grooves;

a driven ring, placed in the drive shaft tube, the driven ring having locking blocks locked in the locking grooves, the driven ring defining a channel, the channel having two sides forming two walls for allowing resting of two sides of the lock snapping plate;

a positioning plate defining openings locked on the positioning tubes of the disk seat, the positioning plate further defining a second hole for allowing passage of the drive shaft tube, the second hole having an inner wall provided with locking edges for allowing engagement or disengagement of end edges of the lock snapping plate, the positioning plate including a plurality of locking pieces for locking in the locking recesses of the lock snapping plate; and a restoring member defining fitting slots combined on end edges of the drive shaft tube, the restoring member further defining a fitting hole for allowing passage of a drive tube which drives the restoring member to rotate, the restoring member including a restoring element mounted thereon.

2. The strength reinforcing structure of a lock outer handle as claimed in claim 1, wherein the driven ring defines a fitting hole for allowing passage of the drive tube which drives the driven ring to rotate.

3. The strength reinforcing structure of a lock outer handle as claimed in claim 1, wherein the drive tube and the driven ring are integrally formed with each other.

4. The strength reinforcing structure of a lock outer handle as claimed in claim 1, wherein the drive tube and the restoring member are integrally formed with each other.

5. A strength reinforcing structure of a lock outer handle comprising:

a disk seat, having positioning tubes and defining a first hole;

a handle, pivotally mounted in the first hole of the disk seat to rotate, the handle provided with a drive plate that is driven by a lock core to rotate, and may drive a lock snapping plate to move along a longitudinal direction thereof;

a drive shaft tube, pivotally mounted in the first hole of the disk seat, having one end secured in the handle, the drive shaft tube receiving an elastic member and a stop plate therein and defining a positioning slot for allowing protrusion of the lock snapping plate, and the other end of the drive shaft tube provided with a plurality of locking grooves;

a driven ring, placed in the drive shaft tube, the driven ring having locking blocks locked in the locking grooves, the driven ring defining a channel, the channel having two sides forming two walls for allowing resting of two sides of the lock snapping plate;

a positioning plate defining openings locked on the positioning tubes of the disk seat, the positioning plate further defining a second hole for allowing passage of the drive shaft tube, the second hole having an inner wall provided with locking edges for allowing engagement or disengagement of end edges of the lock snapping plate, the second hole further includes a plurality of stop protrusions protruding toward a center thereof; and a restoring member defining fitting slots combined on end edges of the drive shaft tube, the restoring member further defining a fitting hole for allowing passage of a drive tube which drives the restoring member to rotate, the restoring member including a restoring element mounted thereon.

6. The strength reinforcing structure of a lock outer handle as claimed in claim 5, wherein the driven ring defines a fitting hole for allowing passage of the drive tube which drives the driven ring to rotate.

7. The strength reinforcing structure of a lock outer handle as claimed in claim 5, wherein the drive tube and the driven ring are integrally formed with each other.

8. The strength reinforcing structure of a lock outer handle as claimed in claim 5, wherein the drive tube and the restoring member are integrally formed with each other.

9. A strength reinforcing structure of a lock outer handle comprising:

a disk seat, having positioning tubes and defining a first hole;

a handle, pivotally mounted in the first hole of the disk seat to rotate, the handle provided with a drive plate that is driven by a lock core to rotate and drive a lock snapping plate to move along a longitudinal direction thereof, the lock snapping plate having a plurality of locking recesses;

a drive shaft tube, pivotally mounted in the first hole of the disk seat, having one end secured in the handle, the drive shaft tube receiving an elastic member and a stop plate therein and defining a positioning slot for allowing protrusion of the lock snapping plate;

a positioning plate defining openings locked on the positioning tubes of the disk seat, the positioning plate further defining a second hole for allowing passage of the drive shaft tube, the second hole having an inner wall provided with locking edges for allowing engagement or disengagement of end edges of the lock snapping plate, the positioning plate including a plurality of locking pieces for locking in the locking recesses of the lock snapping plate; and a restoring member defining fitting slots combined on end edges of the drive shaft tube, the restoring member further defining a fitting hole for allowing passage of a drive tube which drives the restoring member to rotate, the restoring member including a restoring element mounted thereon, and the restoring member having a center provided with an integral driven ring, the driven ring defining a channel, the channel having two sides forming two walls for allowing resting of two sides of the lock snapping plate.

10. The strength reinforcing structure of a lock outer handle as claimed in claim 9, wherein the drive tube and the driven ring are integrally formed with each other.

11. The strength reinforcing structure of a lock outer handle as claimed in claim 9 wherein the drive tube and the restoring member are integrally formed with each other.

12. A strength reinforcing structure of a lock outer handle comprising:

a disk seat, having positioning tubes and defining a first hole;

a handle, pivotally mounted in the first hole of the disk seat to rotate, the handle provided with a drive plate that is driven by a lock core to rotate, and may drive a lock snapping plate to move along a longitudinal direction thereof;

a drive shaft tube, pivotally mounted in the first hole of the disk seat, having one end secured in the handle, the drive shaft tube receiving an elastic member and a stop plate therein and defining a positioning slot for allowing protrusion of the lock snapping plate;

a positioning plate defining openings locked on the positioning tubes of the disk seat, the positioning plate further defining a second hole for allowing passage of the drive shaft tube, the second hole having an inner wall provided with locking edges for allowing engagement or disengagement of end edges of the lock snapping plate, the second hole further includes a plurality of stop protrusions protruding toward a center thereof; and a restoring member defining fitting slots combined on end edges of the drive shaft tube, the restoring member further defining a fitting hole for allowing passage of a drive tube which drives the restoring member to rotate, the restoring member including a restoring element mounted thereon, and the restoring member having a center provided with an integral driven ring, the driven ring defining a channel, the channel having two sides forming two walls for allowing resting of two sides of the lock snapping plate.

13. The strength reinforcing structure of a lock outer handle as claimed in claim 12, wherein the drive tube and the driven ring are integrally formed with each other.

14. The strength reinforcing structure of a lock outer handle as claimed in claim 12, wherein the drive tube and the restoring member are integrally formed with each other.

* * * * *